US005882094A

United States Patent [19]

Parsley

[11] Patent Number: 5,882,094

[45] Date of Patent: Mar. 16, 1999

[54] RECESSED STORAGE CABINET

[76] Inventor: Clifford M. Parsley, 3061 Harrison St., San Francisco, Calif. 94110

[21] Appl. No.: 859,617

[22] Filed: May 20, 1997

[51] Int. Cl.[6] ..... A47B 67/02

[52] U.S. Cl. ..... 312/242; 312/124; D6/515

[58] Field of Search ..... 312/242, 245, 312/224, 227, 211, 117, 118, 121, 124, 42, 50, 60, 72; D6/515, 517, 520, 526, 530

[56] References Cited

U.S. PATENT DOCUMENTS

| | | | |
|---|---|---|---|
| D. 317,384 | 6/1991 | Powell | D6/515 |
| D. 329,343 | 9/1992 | Oldorf | D6/515 |
| D. 359,641 | 6/1995 | Kwan | D6/515 |
| D. 376,513 | 12/1996 | Curry | D6/515 |
| 908,344 | 12/1908 | Simanek | 312/124 X |
| 2,860,941 | 11/1958 | Fromwiller | 312/36 |
| 2,878,955 | 3/1959 | Hagan | 312/242 X |
| 3,475,070 | 10/1969 | Hoshall | 312/42 X |
| 4,134,625 | 1/1979 | Palka | 312/227 X |
| 4,681,380 | 7/1987 | Carlin | 312/242 |
| 5,072,997 | 12/1991 | Mayfield, III | 312/124 X |
| 5,163,745 | 11/1992 | Zagata | 312/242 |
| 5,213,402 | 5/1993 | Bernal et al. | 312/242 |
| 5,368,378 | 11/1994 | Curtis | 312/242 X |
| 5,577,819 | 11/1996 | Olsen | 312/242 |

*Primary Examiner*—Peter M. Cuomo
*Assistant Examiner*—James O. Hansen

[57] ABSTRACT

A recessed storage cabinet includes a face, a back, a top, a bottom, and opposite sides. A plurality of vertically elongated compartments are defined by a plurality of partitions extending between the top and bottom, and between the face and back. An in-feed aperture and an out-feed aperture are positioned through the face at respectively the top and bottom of each compartment. Articles are stored in the compartments by being inserted individually through the in-feed apertures, and retrieved individually through the out-feed apertures. A door is hinged to the face at a vertical side. The cabinet is sized for recessed mounting within wall between studs.

2 Claims, 1 Drawing Sheet

RECESSED STORAGE CABINET

BACKGROUND

1. Field of Invention

This invention relates to the storage and dispensing of articles utilizing the space between the studs of standard wall construction.

2. Description of prior art

Bathroom fixtures such as medicine cabinets and paper dispensers are common recessed storage devices. Mechanical devices such as candy bar dispensers employ vertical bays and bottom dispensing. I am not aware of, nor could I find in the official record of patents, any recessed device which stores and dispenses small articles of clothing in a combination of these two ways. U.S. Pat. No. 4,076,350 describes a general cabinet recessed in a wall cavity and having a loose or adjustable face frame. U.S. Pat. No. 4,681,380 describes a unitary plastic cabinet with face flange used for mounting.

OBJECTS, ADVANTAGES AND SUMMARY

Several objects and advantages to the present invention are;

(a) to store small articles of clothing conveniently;

(b) to utilize otherwise unused space and save space elsewhere;

(c) to dispense sequentially, and thus cause the articles to be worn in rotation.

In accordance with the present invention, a recessed storage cabinet comprises a closed box recessed into the space formed by the studs of a standard wall or into any other under-used space. The box has open ends for insertion and retrieval of articles.

DRAWING FIGURES BRIEF DESCRIPTION

REFERENCE NUMERALS IN FIGURES

| | |
|---|---|
| 2 body of cabinet | 4 face of catinet |
| 6 out-feed aperture | 8 in-feed aperture |
| 10 internal vertical partition | 12 door |

DESCRIPTION OF THE PREFERRED EMBODIMENT

Figure 1A:
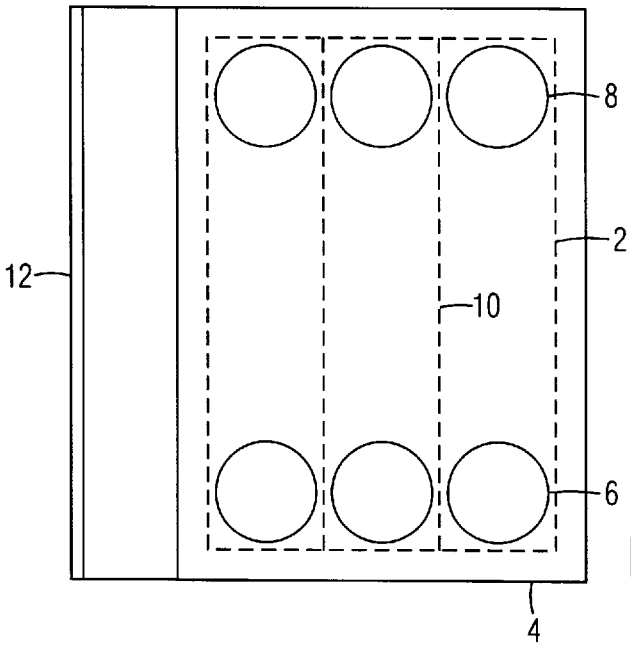
FIG. 1A shows face-on view of cabinet.
Figure 1B:
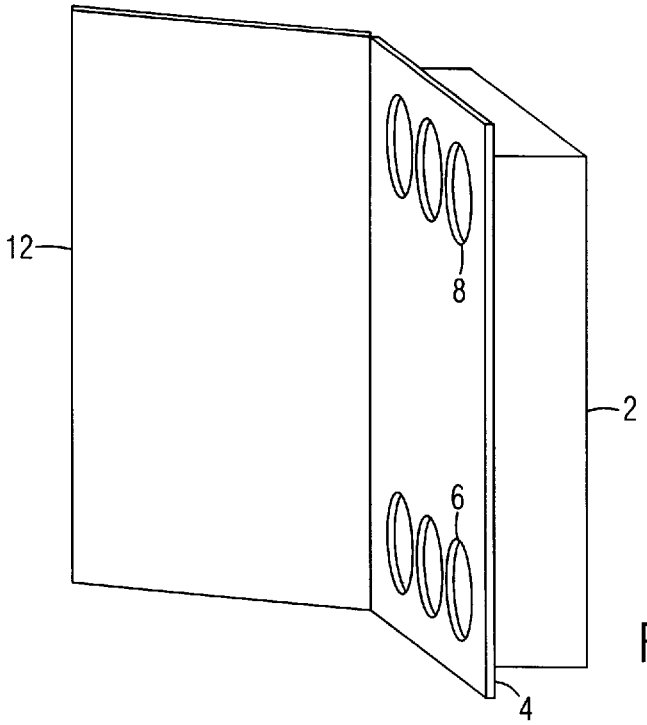
FIG. 1B shows side view of cabinet

A typical embodiment of the present invention is illustrated in FIG. 1A ( front view) and FIG. 1B (side view). The cabinet has a body 2 consisting of top, bottom, two sides and back; and consists of one or more vertical compartments formed by the sides and vertical partition 10 as required. The face 4 has an in-feed aperture 8 at the top and an out-feed aperture 6 at the bottom of each vertical compartment to allow insertion and retrieval of articles and is permanently attached to the body. The door 12 is hinged at one vertical side.

OPERATION

Once installed, the user fills the vertical bays at the top with small folded articles to be stored and takes them one at a time from the bottom of each bay.

I claim:

1. A storage cabinet, comprising:

a face;

a back spaced from said face;

a pair of opposite sides connecting said face and said back;

a top and a bottom connecting said face and said back, said face extending beyond said sides, said top, and said bottom forming a mounting flange;

a door hinged to said face;

a plurality of spaced-apart vertical partitions each connected between said face and said back, and between said top and said bottom, said partitions defining a plurality of isolated compartments for storing a plurality of articles in a plurality of columns isolated from each other for preventing mixing of said articles between said columns;

an in-feed aperture extending through said face at a top-most position of each of said isolated compartments for receiving said articles inserted individually; and an out-feed aperture extending through said face at a bottom-most position of each of said isolated compartments for dispensing said articles individually, said face being completely solid between said in-feed aperture and said out-feed aperture, each of said isolated compartments channeling a corresponding column of said articles only to a corresponding out-feed aperture for dispensing said articles sequentially.

2. A storage cabinet, comprising:

a face;

a back spaced from said face;

a pair of opposite sides connecting said face and said back;

a top and a bottom connecting said face and said back;

a plurality of spaced-apart vertical partitions each connected between said face and said back, and between said top and said bottom, said partitions defining a plurality of isolated compartments for storing a plurality of articles in a plurality of columns isolated from each other for preventing mixing of said articles between said columns;

an in-feed aperture extending through said face at a top-most position of each of said isolated compartments for receiving said articles inserted individually; and an out-feed aperture extending through said face at a bottom-most position of each of said isolated compartments for dispensing said articles individually, said face being completely solid between said in-feed aperture and said out-feed aperture, each of said isolated compartments channeling a corresponding column of said articles only to a corresponding out-feed aperture for dispensing said articles sequentially.

* * * * *